United States Patent [19]

Mensing et al.

[11] Patent Number: 4,976,676

[45] Date of Patent: Dec. 11, 1990

[54] LONGITUDINAL SLITTING AND/OR GROOVING MACHINE FOR TRANSPORTED MATERIAL SHEETS, PARTICULARLY FOR SHEETS OF CORRUGATED BOARD

[75] Inventors: Hermann Mensing, Weiherhammer; Reinhard Sternitzke, Kaltenbrunn; Karl Waldeck, Etzenricht; Klaus Schnabel, Grafenwöhr, all of Fed. Rep. of Germany

[73] Assignee: BHS-Bayerische Berg-, Hutten- und Salzwerke Aktiengesellschaft, Fed. Rep. of Germany

[21] Appl. No.: 389,500

[22] Filed: Aug. 4, 1989

[30] Foreign Application Priority Data

Aug. 9, 1988 [DE] Fed. Rep. of Germany ..... 3826993

[51] Int. Cl.[5] ..... B31F 1/00

[52] U.S. Cl. ..... 493/365; 83/479; 83/500; 83/508.1; 83/508.3

[58] Field of Search ..... 83/508.1, 499, 498, 83/504, 425.4, 500, 508.2, 508.3, 503, 506, 479, 480; 493/354, 355, 370, 402, 403, 361, 365, 366, 367

[56] References Cited

U.S. PATENT DOCUMENTS

| | | | |
|---|---|---|---|
| 3,929,047 | 12/1975 | Brandl | 83/425.4 |
| 4,142,455 | 3/1979 | Coburn | 83/479 |
| 4,224,847 | 9/1980 | Tokuno | 83/479 |
| 4,261,239 | 4/1981 | Toboshi et al. | 493/355 |
| 4,295,843 | 10/1981 | Otomaru | 493/354 |
| 4,328,727 | 5/1982 | Tokuno | 83/479 |
| 4,380,945 | 4/1983 | Gild et al. | 83/498 |
| 4,506,577 | 3/1985 | Shinomiya et al. | 83/500 |
| 4,516,454 | 5/1985 | Mosburger | 83/499 |
| 4,563,930 | 1/1986 | Schommler et al. | 83/479 |

FOREIGN PATENT DOCUMENTS

| | | |
|---|---|---|
| 2436717 | 5/1985 | Fed. Rep. of Germany . |
| 2139135 | 11/1984 | United Kingdom . |

*Primary Examiner*—Douglas D. Watts
*Assistant Examiner*—Hwei-Siu Payer
*Attorney, Agent, or Firm*—Silverman, Cass & Singer, Ltd.

[57] ABSTRACT

An apparatus for longitudinally slitting and/or grooving material sheets, particularly for sheets of corrugated board, which are being transported through the apparatus. The apparatus includes a plurality of tool members positioned in rows on opposing sheet sides which cooperate in opposing pairs. Each set of rows includes a drive shaft and an adjusting spindle in operable communication with the tool members which include tool body members and which can be conducted within the apparatus along guide rails and can be coupled through controllable couplings to the adjusting spindles. Each tool body member also includes a plurality of tool members where at least one of the tool body members and guide rails are adjustable within the apparatus to position the opposing pair of tool members in the operating positions in engagement with the sheet.

14 Claims, 2 Drawing Sheets

LONGITUDINAL SLITTING AND/OR GROOVING MACHINE FOR TRANSPORTED MATERIAL SHEETS, PARTICULARLY FOR SHEETS OF CORRUGATED BOARD

BACKGROUND OF THE INVENTION

1. Field of the Invention

The invention relates generally to an apparatus for slitting and/or grooving material sheets, and more particularly to an apparatus for longitudinally slitting and/or grooving sheets of corrugated board having a plurality of tool members which can be selectively engaged with the corrugated board.

2. Description of the Prior Art

One example of an existing apparatus for longitudinally slitting and/or grooving material sheets is shown in German Disclosure DE-PS 32 02 914. A major disadvantage with the apparatus of that German Disclosure is that it is impossible to change tools during operation of the apparatus.

It therefore is desirable to provide an apparatus for longitudinally slitting and/or grooving material sheets, particularly sheets of corrugated board, which enables replacement of damaged or worn tools or substitution of tools with other slitting and/or grooving profiles during operation of the apparatus within a minimum amount of time.

SUMMARY OF THE INVENTION

The invention provides an apparatus for longitudinally slitting and/or grooving material sheets, particularly for sheets of corrugated board, which are being transported through the apparatus. The apparatus includes a plurality of tool body members positioned in rows on opposing sheet sides which cooperate in opposing pairs. Each set of rows includes a drive shaft and an adjusting spindle in operable communication with the tool body members which include tool members and which can be conducted within the apparatus along guide rails and can be coupled through controllable couplings to the adjusting spindles. Each tool body member also includes a plurality of tool members where at least one of the tool body members and guide rails are adjustable within the apparatus to position the opposing pair of tool members in the operating positions in engagement with the sheet.

Accordingly, since the invention provides multiple tools, preferably two, on one tool body, and individual or all tool bodies are positioned in a swivelling manner which enables the tools to be utilized in an alternating manner, it is possible to replace worn tools or even to substitute tools with other profiles without great expenditure of time.

DESCRIPTION OF THE PREFERRED EMBODIMENTS

Figure 1:
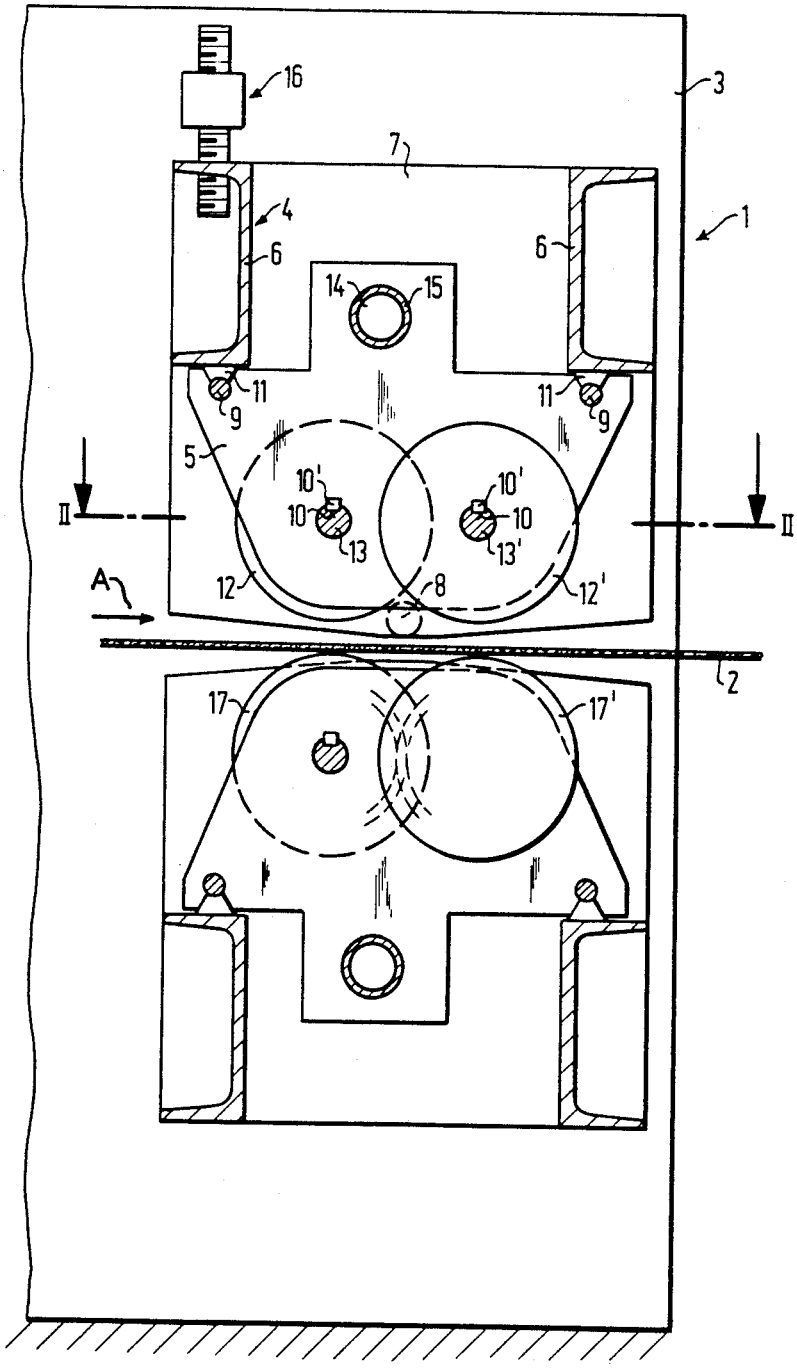
FIG. 1 is a vertical cross-sectional view of the longitudinal slitting and/or grooving apparatus of the invention having a sheet of transported material running therethrough.

Referring to FIG. 1, a longitudinal slitting and/or grooving apparatus of the invention is designated generally by the reference numeral 1. The apparatus 1 typically is used to provide a slit and/or groove in a sheet of corrugated board 2 which runs through the apparatus 1 in the direction of arrow "A".

The apparatus 1 includes a stationary machine framework or support frame 3 which only is partially illustrated in FIG. 1. The machine framework 3 supports a guide bed 4 for support of a plurality of tool body members 5 within the apparatus 1.

The guide bed 4 includes two parallel longitudinal supports or guide rails 6 which are positioned a desired distance apart. The guide rails 6 extend in a lateral direction with respect to the longitudinal axis of the sheet of corrugated board 2 running through the apparatus 1. The longitudinal supports 6 are firmly connected to each other at their ends by shielding plates 7. The shielding plates 7 are connected to the machine framework 3 by means of a swivelling peg 8. The longitudinal supports 6 on their lower sides also include parallel guide rails 9 which generally are circular in cross-section.

In order to connect the tool bodies 5 to the longitudinal supports 6, each tool body 5 includes a fitting 11 on its upper side for accommodating the guide rails 9. Each tool body 5 can support several cutting or grooving tools. In this exemplary embodiment, two tool members 12 and 12′ are illustrated. It is to be understood, however, that the number of tools per tool body 5 can vary. Thus, as will be explained in detail hereinafter, a worn tool can be replaced or a tool having a different profile can be substituted in a minimum amount of time without significantly interrupting the operation of the apparatus 1 or the flow of corrugated board 2.

The tools 12 and 12′ are driven rotationally by means of separate parallel drive shafts 13 and 13′. The drive shafts 13 and 13′ do not rotate with respect to the tools 12 and 12′. Furthermore, the tools 12 and 12′ are longitudinally displaceable along the length of the drive shafts 13 and 13′ respectively. To provide rotational and longitudinal displacement of the tools 12 and 12′, the drive shafts 13 and 13′ have longitudinal grooves 10 within which wedge units or keys 10′ engage.

It is to be noted that it also is possible to directly drive only one of the tools 12 or 12′ by means of a single drive shaft 13 or 13′. In such a situation, the tools 12 and 12′ are connected by means of gearings (not illustrated) which mesh with one another.

The tools 12 and 12′ are positioned in successively placed rows, one behind the other, in a direction lateral to the direction of arrow "A". For lateral movement of the tools 12 and 12′ and the tool bodies 5, along the drive shafts 13 and 13′, with respect to the longitudinal axis of the corrugated board 2, an adjusting spindle 14 is included which passes through the apparatus 1. To connect the tool bodies 5 to the spindle 14, each tool body 5 includes a controllable coupling 15. Such adjusting drives are known and a description of the specific operation of such drives will not be provided herein. It is to be noted that the manner in which the tool bodies 5 are moved laterally in the apparatus 1 can vary.

In the preferred operation of the apparatus 1, only one tool 12 or 12′ per tool body 5 is in engagement with the corrugated board 2 at one particular time. If desired, however, one or more tool bodies 5 can be positioned above the corrugated board 2 whereupon one tool 12 or 12′ from each tool body 5 so positioned can engage the corrugated board 2 at the same time.

In order for one of the tools 12 or 12' to be brought into the operating position where it is in engagement with the corrugated board 2, the tool 12 or 12' must be lowered from the position illustrated in FIG. 1. To provide this lowering, the guide bed 4 is connected to an adjusting device 16 which in turn is connected to the stationary machine framework 3. Such an adjusting device 16 preferably is constructed as a spindle elevating device which engages the guide bed 4 on one end thereof outside the central plane or rotational axis of the guide bed 4. Thus, by moving the adjusting device 16 vertically it is possible to swivel the guide bed 4 around the rotating peg 8 in a limited manner.

Since the tools 12 and 12' preferably are positioned symmetrically about the central plane or axis of the guide bed 4, one or the other of the tools 12 or 12' can be brought in a simple and alternating manner into the operating position in which such a tool engages the sheet of corrugated board 2 by means of the adjusting device 16.

Typically, several units of tools are positioned one behind the other in the longitudinal direction of the sheet of corrugated board 2 (not illustrated). Accordingly, several rows of cutting tools and several rows of grooving tools are present to perform several types of cutting and grooving operations on the corrugated board 2 in succession.

As FIG. 1 illustrates, in order to slit and/or groove the corrugated board 2 simultaneously from both sides thereof, tools 17 and 17' can be provided which are positioned below the sheet of corrugated board 2. The operation of the tools 17 and 17' is similar to the operation of the tools 12 and 12' as discussed above.

Figure 2:
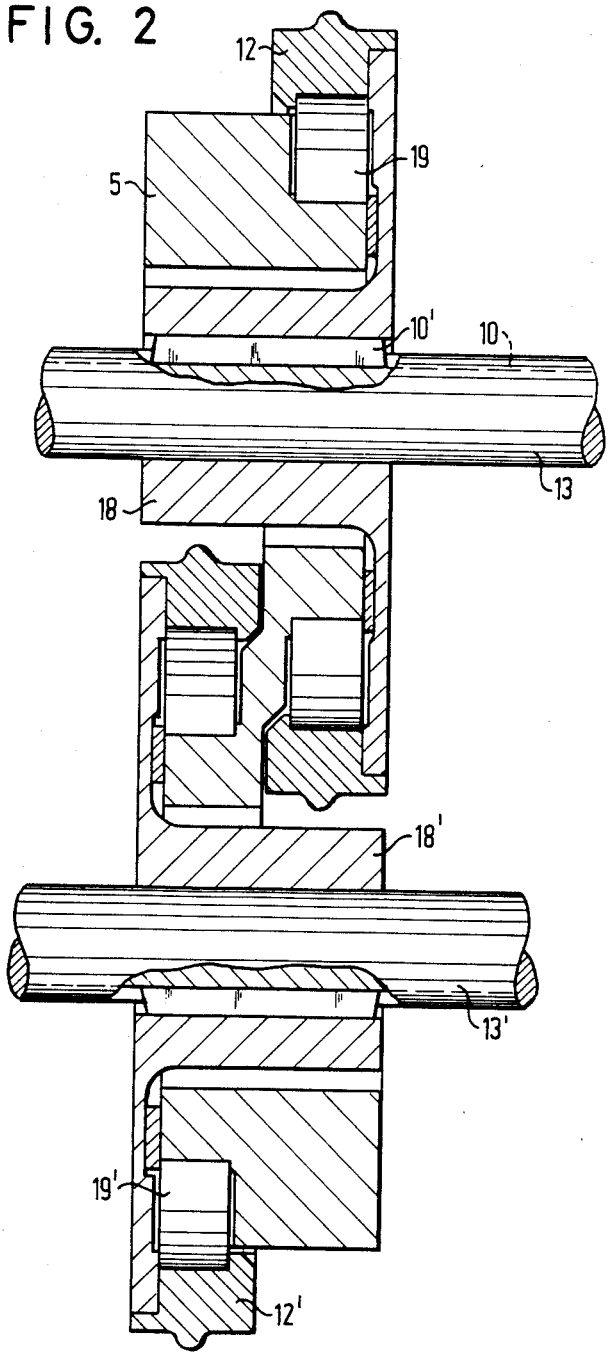
FIG. 2 is a partial sectional view taken along line II—II of FIG. 1 in the direction indicated generally.

As FIG. 2 illustrates, the tools 12 and 12' can be positioned not only in a plane parallel to the longitudinal central axis of the sheet of corrugated board 2, but also in an overlapping arrangement as well. To accomplish this overlapping, the tool supports 18 and 18', which are connected with the drive shafts 13 and 13' in a non-rotating but displaceable manner, are constructed in a hub-like manner. The ring-shaped grooving tools 12 and 12' supported thereby then can occupy a certain overlap or offset position relative to one another. During the change of tools, a corresponding readjustment must then take place. The grooving tools 12 and 12' are rotationally supported by means of ball bearings 19 and 19' on the tool body 5 which has a thickness differing in its cross-section.

Instead of swivelling the entire guide bed 4 about the peg 8 and thereby all the tools 12 and 12' and tool bodies 5 at once, it also is possible to swivel each tool body 5 and thereby the corresponding tools 12 and 12' individually, either into or out of the operating or engagement position with the corrugated board 2.

Additionally, instead of providing only two tools 12 and 12' on a tool body 5, it also is possible to provide several tools on a single tool body 5, particularly if a revolver-like mounting construction of the tools on the tool body 5 is utilized.

It also is possible to construct only the lower guide bed for the tools 17 and 17' or the upper and the lower alike, in a swivellable manner.

Modifications and variations of the present invention are possible in light of the above teachings. A specific dimension, material or construction is not required so long as the assembled apparatus is able to function as herein described. It is therefore to be understood that within the scope of the appended claims, the invention may be practiced otherwise than as specifically claimed.

What is claimed and desired to be secured by letters patent of the U.S. is

1. An apparatus for longitudinally slitting and grooving material sheets, particularly for sheets of corrugated board, comprising guide beds tiltably supported in a framework of the apparatus and positioned laterally with respect to the direction of travel of the sheet through the apparatus above and below the sheet, the guide beds being disposed parallel to and spaced from one another, said guide beds including tool body members adjustably held in said guide beds by adjusting spindles and couplings, and a plurality of tool members mounted on each tool body member which are selectively engageable with the sheet so that, upon tilting of said guide beds, designated upper and lower tool members cooperate in pairs and are rotatably driven to longitudinally slit and groove the material sheets.

2. The apparatus as defined in claim 1 wherein said guide beds are in operable communication with guide rails and are mounted to the framework of said apparatus in a rotational manner about a swivelling axis and further including an adjusting device positioned between the guide bed and the framework.

3. The apparatus as defined in claim 2 wherein said guide rails are firmly connected on at least one of their ends with a shielding plate, said shielding plate being connected to the framework of said apparatus by a swivelling peg and including adjusting means on one side of said guide rails for rotationally adjusting said shielding plate and said guide rails about said peg.

4. The apparatus as defined in claim 1 wherein said plurality of tool members of each tool body member are positioned adjacent to each other in a common lateral plane.

5. The apparatus as defined in claim 1 wherein said plurality of tool members of each tool body member are displaced and overlapped with respect to each other.

6. The apparatus as defined in claim 1 wherein one drive shaft is provided for one only tool member of said tool body member and the remaining tool members of said tool body member are connected through gearing means to said one drive shaft.

7. An apparatus for slitting and grooving material sheets, particularly for sheets of corrugated cardboard, which are being transported through or past said apparatus comprising:

a support frame for mounting the apparatus to a desired surface;

at least one tool body member;

a plurality of substantially circular tool members rotatably mounted on said tool body member which are selectively engageable with the sheet;

at least one guide rail connecting said tool body member to said support frame, said tool body member being movable along said guide rail for pre-positioning at least one of said tool members of said tool body member into a desired position proximate to but remote from the sheet in preparation for engagement with the sheet;

an adjustable spindle connected to said tool body member by a controllable coupling for positioning said tool body member along said guide rail; and means for moving at least one of said tool members from the desired position into engagement with one side of the sheet whereby only one tool member is engageable with the sheet at a given time.

8. The apparatus as defined in claim 7 including at least one additional tool body member having a plurality of tool members mounted to the apparatus for simultaneous engagement with an opposite side of said sheet and including at least one guide rail connecting said additional tool body member to said support frame, said additional tool body member being movable along said guide rail for pre-positioning said tool members and said additional tool body member into a desired position proximate to but remote from said sheet in preparation for engagement with the opposite side of said sheet; an adjustable spindle connected to said tool body member by a controllable coupling for positioning said additional tool body member along said guide rail; and means for moving said tool members of said additional tool body member from the desired position into engagement with the opposite side of said sheet.

9. The apparatus as defined in claim 7 including at least one drive shaft for each of said plurality of tool members for providing rotational movement of said tool members.

10. The apparatus as defined in claim 7 including at least one drive shaft for direct rotational communication with at least one of said plurality of tool members, said remaining tool members of said tool body member being connected through gearing means to said drive shaft.

11. The apparatus as defined in claim 7 including a plurality of tool body members, each having a plurality of tool members, and at least one drive shaft for providing rotational movement to said plurality of tool members of each tool body member.

12. The apparatus as defined in claim 7 wherein said means for moving includes a shielding plate connected to at least one end of said rail, said shielding plate further being connected to said support frame by a swivelling peg, and adjusting means for rotating said shielding plate.

13. The apparatus as defined in claim 7 wherein said means for moving includes a guide bed in operable communication with said guide rail, which is mounted to said support frame in a rotational manner about a swivelling axis.

14. The apparatus as defined in claim 13 including adjusting means for rotationally adjusting said guide bed about said swivelling axis.

* * * * *